US012150533B2

(12) United States Patent
Waswill

(10) Patent No.: US 12,150,533 B2
(45) **Date of Patent: *Nov. 26, 2024**

(54) SPORTS BAG

(71) Applicant: John J. Waswill, Marlborough, MA (US)

(72) Inventor: John J. Waswill, Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,070

(22) Filed: May 16, 2022

(65) Prior Publication Data

US 2022/0265018 A1 Aug. 25, 2022

Related U.S. Application Data

(63) Continuation-in-part of application No. 17/022,244, filed on Sep. 16, 2020, now Pat. No. 11,330,878.

(51) Int. Cl.

| | |
|---|---|
| ***A45C 13/26*** | (2006.01) |
| ***A45C 3/00*** | (2006.01) |
| ***A45C 7/00*** | (2006.01) |
| ***A45C 13/10*** | (2006.01) |
| ***A45F 3/00*** | (2006.01) |
| ***A45F 3/02*** | (2006.01) |

(52) U.S. Cl.

CPC ..... *A45C 13/26* (2013.01); *A45C 3/004* (2013.01); *A45C 7/0086* (2013.01); *A45C 7/0095* (2013.01); *A45C 13/103* (2013.01); *A45C 13/1069* (2013.01); *A45F 3/005* (2013.01); *A45F 3/02* (2013.01); *A45C 2013/1015* (2013.01)

(58) Field of Classification Search

CPC ..... A45C 13/26; A45C 3/004; A45C 7/0086; A45C 7/0095; A45C 13/103; A45C 13/1069; A45C 2013/1015; A45F 3/005; A45F 3/02

USPC ..... 224/153

See application file for complete search history.

(56) References Cited

U.S. PATENT DOCUMENTS

| | | | | |
|---|---|---|---|---|
| 3,128,854 A * | 4/1964 | Name not available | ..... | A45C 3/00 206/289 |
| 3,442,427 A * | 5/1969 | Arnell | ..... | A45F 3/08 224/261 |
| 3,530,919 A * | 9/1970 | May | ..... | A63B 55/40 224/583 |
| 3,779,502 A * | 12/1973 | Marberg | ..... | B65D 19/44 410/116 |
| 4,515,300 A * | 5/1985 | Cohen | ..... | A45F 3/04 224/579 |

(Continued)

*Primary Examiner* — Peter N Helvey

(74) *Attorney, Agent, or Firm* — LORUSSO & ASSOCIATES

(57) ABSTRACT

A segmented bag with a single continuous strap or dual or more straps. A duffle bag with two segments secured together with diametrically opposed longitudinal zippers, hook-and-loop fasteners and/or magnets. A multi-segmented bag with two semi-cylindrical segments secured together with longitudinal zippers and each semi-cylindrical segment having quarter sections secured together with an annular zipper. The single continuous strap functions as a hand grip or a shoulder strap and maintains the connectivity of the duffle bag segments even when separated. The dual strap permits the releasably secured bag segments to be separated completely.

8 Claims, 6 Drawing Sheets

(56) References Cited

U.S. PATENT DOCUMENTS 4,693,344 A * 9/1987 Shuler ..... A45C 7/0095 190/111
4,703,519 A * 10/1987 Krenzel ..... A45C 3/02 D3/270
4,753,329 A * 6/1988 Choy ..... A45C 7/0095 190/111
5,042,703 A * 8/1991 Izzo ..... A45F 3/04 206/315.3
5,375,929 A * 12/1994 Bergmoser ..... B65D 85/34 426/106
5,490,619 A * 2/1996 Boyar ..... A45C 7/0077 224/613
5,573,156 A * 11/1996 McConnell ..... A47D 13/02 D3/214
D386,613 S * 11/1997 Terzian ..... D3/289
6,039,474 A * 3/2000 DeChant ..... A45C 3/00 383/66
6,334,519 B1 * 1/2002 Tong ..... A45C 7/0086 190/110
6,619,447 B1 * 9/2003 Garcia, III ..... A45C 7/0086 190/110
D530,915 S * 10/2006 Sijmons ..... D3/289
7,278,539 B2 * 10/2007 Souza ..... A45C 3/00 190/110
8,413,776 B1 * 4/2013 Huff ..... A45C 3/00 150/113
8,678,679 B2 * 3/2014 Xu ..... G03B 17/563 396/423
8,695,796 B2 * 4/2014 Byers ..... A45F 3/04 206/315.9
D793,717 S * 8/2017 Boljat ..... D3/315
9,854,889 B2 * 1/2018 Amago ..... A45C 13/02
10,406,964 B1 * 9/2019 Thompson ..... B60P 7/0807
10,427,874 B1 * 10/2019 Hurd ..... B65D 85/68
11,554,300 B2 * 1/2023 Wright ..... A63B 24/0003
2002/0096409 A1 * 7/2002 Roegner ..... A45C 13/02 190/109
2003/0223651 A1 * 12/2003 Weleczki ..... A45C 9/00 383/4
2004/0008907 A1 * 1/2004 Bartlett ..... A01K 97/06 383/7
2004/0108179 A1 * 6/2004 Scicluna ..... A45C 7/0054 190/115
2005/0092803 A1 * 5/2005 Collier ..... A45F 3/047 224/631
2006/0239593 A1 * 10/2006 Fidrych ..... A45C 13/02 383/110
2007/0017948 A1 * 1/2007 Smithson ..... A63B 47/021 224/663
2008/0035693 A1 * 2/2008 Lee ..... A45F 3/047 224/578
2010/0078280 A1 * 4/2010 Mauro ..... A45C 7/0045 190/111
2010/0270348 A1 * 10/2010 Demskey ..... A45F 3/14 224/579
2012/0261445 A1 * 10/2012 Demskey ..... A45F 3/14 224/259
2014/0191007 A1 * 7/2014 Demskey ..... A45C 15/00 224/579
2015/0136824 A1 * 5/2015 Demskey ..... A45F 3/02 29/25.35
2016/0100673 A1 * 4/2016 Demskey ..... A45C 13/30 224/257
2017/0231298 A1 * 8/2017 Thomas ..... A41D 15/04 224/153
2017/0231299 A1 * 8/2017 Feterman ..... A45C 13/123 224/153
2017/0251771 A1 * 9/2017 Wang ..... A45C 7/0027

* cited by examiner

SPORTS BAG

CROSS-REFERENCE TO RELATED APPLICATIONS

This Regular Utility Application is a Continuation-In-Part of, and claims priority to, U.S. Regular Utility application Ser. No. 17/022,244, filed Sep. 16, 2020, now U.S. Pat. No. 11,330,878, issued May 17, 2022, the contents of which are incorporated herein by reference.

FIELD OF THE DISCLOSURE

The disclosure relates to bags for holding clean and soiled garments and sports equipment. More particularly, this disclosure concerns compartmentalized, foldable and separable bags with single straps that permit the bag to be opened fully without removal of the strap or with multiple straps that permit separable components of the bags to be fully separated.

BACKGROUND OF THE DISCLOSURE

Bags for holding clothing and equipment, sports bags, in particular, often include compartments to hold soiled, sweaty clothing that separate the clothing from other compartments in the bag. The compartments may be constructed with solid compartment walls or may have one or more mesh walls to permit airflow through the compartment. As is commonly known, mesh walls are particularly useful for airing out compartments holding sweaty clothing. These bags often have two straps secured to opposing sides of the bag. When the straps are grasped together, the orientation of the bag straps provides a means to balance the bag when carried.

Another type of bag I created and disclose herein is a modification of the conventional rectangular-shaped sports bag. As shown in FIGS. 1 and 2, my sports bag designated generally as 1 has a cylindrical shape with two separable compartments 2 that are combined or connected along the longitudinal axis of the bag illustratively with a pair of long zippers 3 that begin at a first end of the bag and end at a second end of the bag so the two sections can be completely separated as the bag ends are not connected. Hook and loop fastener strips (Velcro®) or magnets may be used in place of the zippers. Two straps 4, each dedicated to a single bag half, are secured to a specific half via stitching, rivet, hook-and-loop fasteners, magnets and the like connection means, and provide a way to carry the individual sections separately. Each strap may have a shoulder pad or carry grip 5 to provide a cushioning effect when placed on a shoulder or when grasped with a hand. To carry the bag when fully assembled, the two straps may be connected together with something like a Velcro® releasable grip handle and grasped together as is commonly known.

Although my initial bag design provides some very usable and convenient features, the use of two straps can be limiting. My initial design results in the two bag sections or halves being completed separated when unzipped. Once unzipped, the location of the dedicated bag straps, which are positioned to balance the bag when fully assembled, become somewhat unwieldly and unbalanced. Moreover, because the bags are like conventional duffle bags, they can be long and cumbersome in longer sizes, especially if the two halves are separated.

What I have invented further is a combination dual chamber bag with a single continuous strap that can slide through a series of D-rings to permit the bag to be carried, opened freely and disassembled without interference from the strap. By further dividing each cylindrical half into quarters, my new sports bag can be wrapped around the waist like a fanny pack with the strap functioning as a shoulder harness by placing the strap over one or both shoulders. My new bag also has an optional belt feature that makes it possible to secure the free ends of the bag at the front of an individual so the bag is stationary about the waist. This takes pressure off the shoulders when carrying the bag and makes it possible to carry heavier loads.

What is needed is a segmented duffle (or other type) bag with one or more free-flowing straps to provide variability in the way weight is distributed in the bag and how that weight is balanced by the straps when being carried in different configurations and manners. These and other objects of the disclosure will become apparent from a reading of the following summary and detailed description of the disclosure as well as a review of the appended drawings.

SUMMARY OF THE DISCLOSURE

In one aspect of the disclosure, a separable dual-chamber bag is formed with two symmetrical or asymmetrical sections joined together with zippers, hook-and-loop fasteners, magnets and/or combinations thereof to provide a bag structured to be separable into two separate sections. In a further aspect of the disclosure, the separable dual-chamber bag is combined with a single continuous strap that can slide through a series of D-ring assemblies to permit the bag to be carried, separated and opened freely without interference from the strap. The continuous strap is made sufficiently long to permit the strap to extend out when the bag is fully separated and opened.

In another aspect of the disclosure, a segmented and partially separable four-chamber bag is combined with a single continuous strap. The bag is divided along its longitudinal axis into two semi-cylindrical halves. Each half has at least one zipper oriented orthogonal to the longitudinal axis to permit each half to be segmented into quarter or more than quarter sections. The quarter sections are attached at flexion points that permits the quarter sections to be rotated about the flexion points and wrapped around an individual's waist similar in fashion to a fanny pack. The single, continuous strap has sufficient length to function as a single or dual shoulder strap.

In a still further embodiment, my new bag also has a belt feature that makes it possible to secure the free ends of the bag at the front of an individual so the bag remains secured to, and stationary about, the waist. This takes pressure off the shoulders when carrying the bag and makes it possible to carry heavier loads. The duffle bag with quarter sections includes a releasably engageable waist belt to secure the duffle bag around the individual. The waist belt has translational sections to permit the belt to be cinched against the individual. A quick release belt assembly permits and facilitates locking and unlocking the belt.

In another aspect of the disclosure, a segmented dual chamber bag is combined with a single continuous strap that can slide through a series of D-ring assemblies to permit the bag to be carried and opened into two semi-cylindrical segments, each of which can be opened freely without interference from the strap. The continuous strap is made sufficiently long to permit the strap to extend out when the bag is fully separated and opened.

In another aspect of the disclosure dedicated straps are secured to each of the separable segments of a dual-chamber bag to enable the two (or more) separable segments to be completed separable (as shown in FIG. 1). These and other aspects of the disclosure will become apparent from a review of the appended drawings and a reading of the following detailed description of the disclosure.

DETAILED DESCRIPTION OF THE DISCLOSURE

Figure 1:
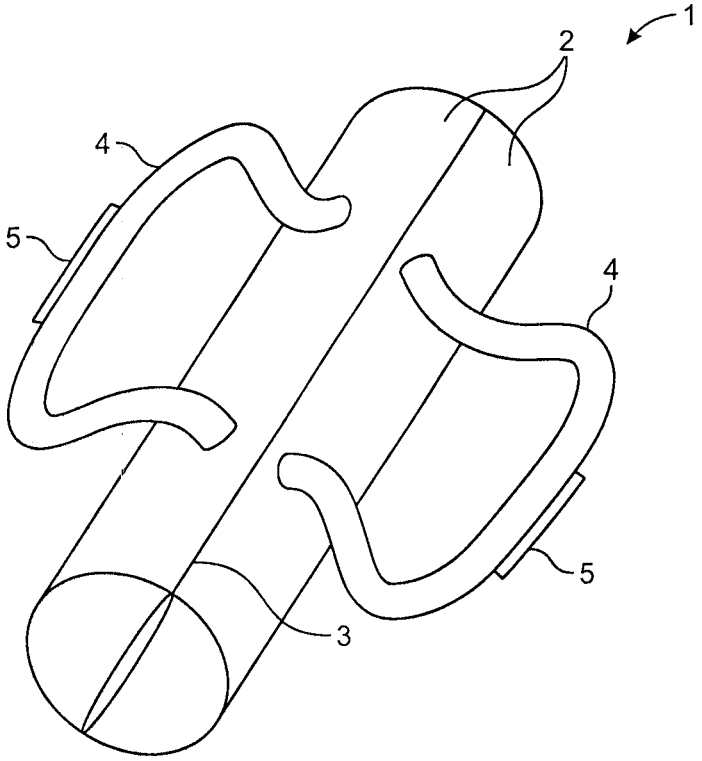
FIG. 1 is a top perspective view of a relevant art duffle bag.
Figure 2:
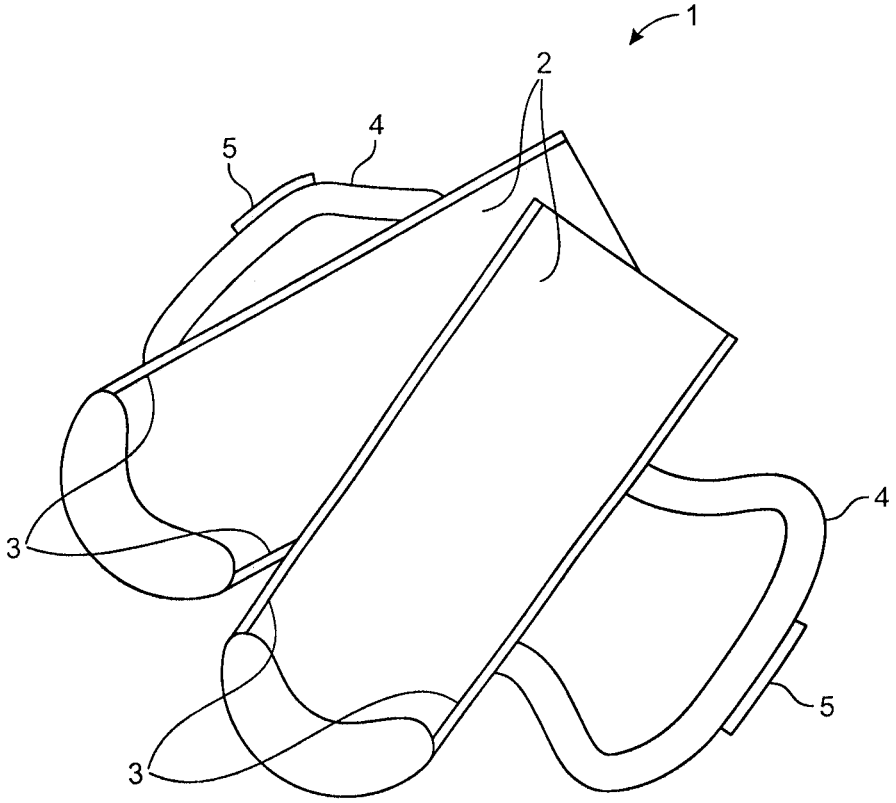
FIG. 2 is an exploded, top perspective view of the duffle bag shown in FIG. 1 with two bag halves separated.
Figure 3:
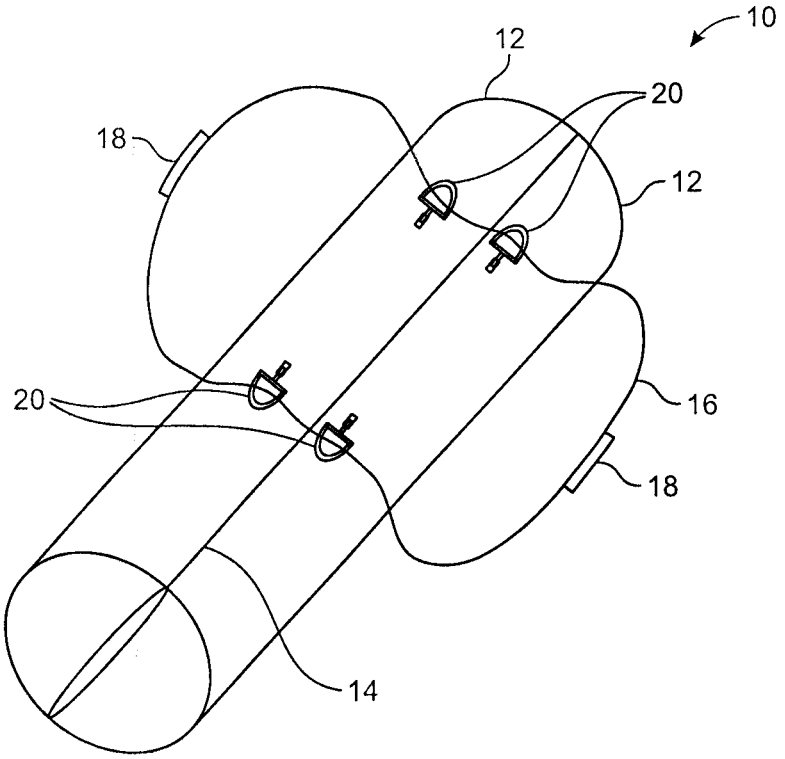
FIG. 3 is a top perspective view of a single-strap, cylindrical duffle bag according to one embodiment of the disclosure.
Figure 4:
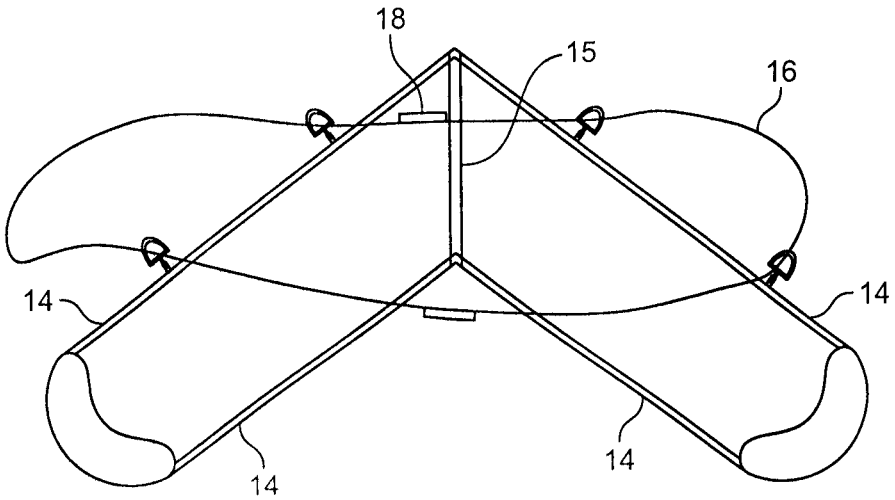
FIG. 4 is an exploded, top perspective view of the cylindrical duffle bag shown in FIG. 3 with two bag halves disassembled.

Referring to FIGS. 3 and 4, in one aspect of the disclosure, a duffle bag designated generally at 10 includes two semi-cylindrical sections 12 secured together with zippers 14 placed along the longitudinal edges of sections 12. Alternatively, sections 12 may be releasably secured together with Velcro® or Velcro-like hook and loop releasable connections. The hook-and-loop connections can be secured to sections 12 via stitching, adhesive and the like.

Figure 12:
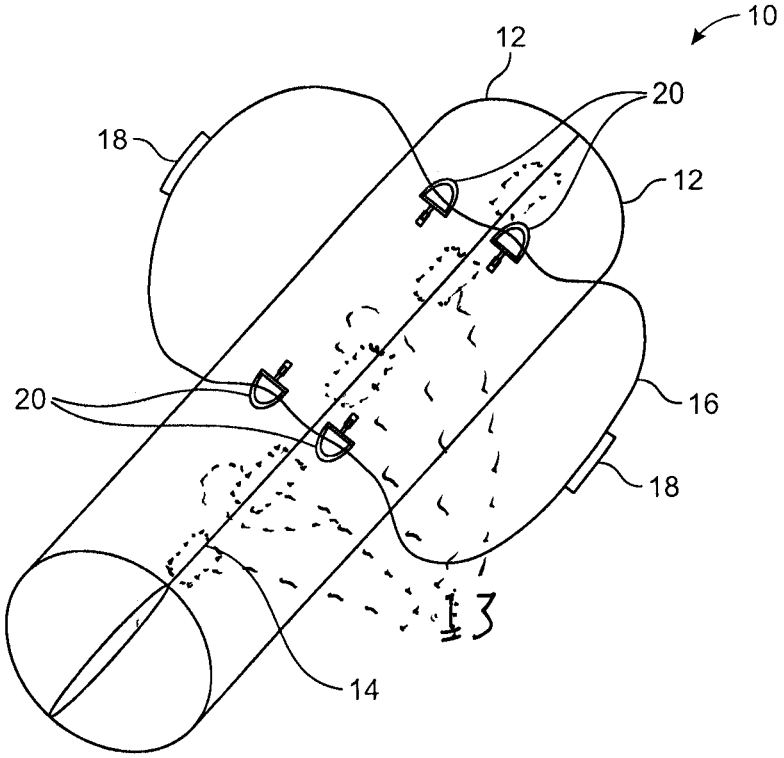
FIG. 12 is a top perspective view of a single-strap bag according to another embodiment of the disclosure
Figure 13:
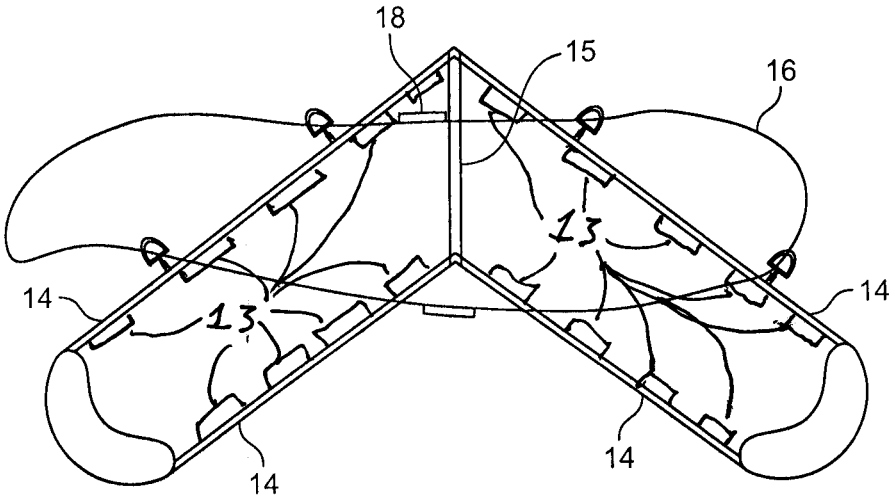
FIG. 13 is an exploded, top perspective view of the bag shown in FIG. 12 with the two bag halves structured or formed with magnets disassembled.

As shown in FIGS. 12 and 13, in a yet further alternative embodiment, magnets 13 are used and secured on or in the walls of the two semi-cylindrical sections to magnetically and releasably secure sections 12 together. In this alternative embodiment, magnets 13 are secured in sections 12 so as to align in pairs. Each pair is oriented so that one of the magnets of the pair has its negative pole facing the registration surface and the second magnet of the pair has its positive pole facing the registration surface. With this alignment, the magnets, when placed sufficiently close, will magnetically engage one another and releasably secure the sections 12 together. To separate sections 12 a separation force is applied to each of the sections 12 to overcome the magnetic force. The strength of magnets used can be tailored to a specific size or type of bag. For example, the strength of the magnets used for a child's' bag can be less than the strength of the magnets used for an adult's bag to enable a child to separate the two sections 12.

A plurality of magnet pairs are placed along the registration surfaces of the sections 12 to distribute the binding force along the perimeters of sections 12. Each magnet 13 can be secured to sections 12 via stitched pouches formed in the walls of the sections, via adhesives, hook-and-loop fasteners secured to the magnets and sections or by any other means known in the art to secure magnets to fabric or sheet-based materials. It should be understood that the number of pairs and the strength of the magnets used can be varied and remain within the scope of the disclosure. It should be understood further that magnet strips that run substantially the entire length of sections 12 may be used to secure the entire registration surfaces of sections 12.

Each section 12 can have single compartment or may include multiple compartments separated illustratively by dividers, pockets, solid flexible walls and mesh walls. Individual closure means such as additional zippers, snap buttons, magnets as described herein, and Velcro® hook and loop releasable connections may be used to further separate multiple compartments. The materials used to construct the duffle bag may be canvas, mylar, nylon, and like materials. It should be understood any material or fabric can be used to construct the duffle bag. It should be understood further that the bag structures and features disclosed herein can apply to any type of bag, such as a handbag, and remain within the scope of the disclosure.

Figure 11:
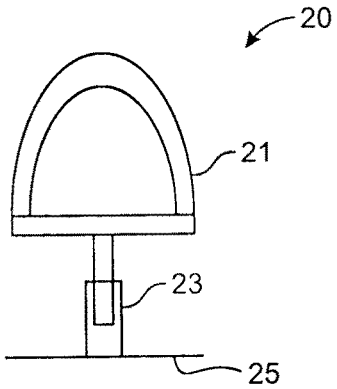
FIG. 11 is a side view in elevation of a D-ring according to one embodiment of the disclosure.

Secured to each section 12 are at least two D-ring assemblies 20. Each D-ring assembly 20 may be fixed directly to section 12 or may have a D-ring 21 secured to a post 23, which, in turn, is secured to an anchor plate 25, as shown in FIG. 11, with the plate secured to section 12. D-ring 21 can rotate about post 23 and be spring actuated to pull away from the post without disengagement. A single continuous strap 16 is passed through the plurality of D-ring assemblies 20. The strap length is set to permit the sections 12 duffle bag 20 to be fully disassembled without interfering with the full separation and axis to the one or more compartments in sections 12 as shown in FIG. 4. One or more shoulder pads/hand grips 18 formed with slots for receiving and interweaving with strap 16 permit shoulder pad/hand grip 18 to be positioned at different points along strap 16 to provide customization for differently sized individuals.

As shown in FIG. 4, a back end of duffle bag 10 (or more generally bag 10) includes a section connection zipper 15 to releasably secure sections 12 together at a single end so the sections may be separated sufficiently to empty or fill the sections. Zipper 15 permits the sections 12 to be fully disassembled or can function as a hinge to permit the sections to be spread apart, but maintained connected. Alternatively, zipper 15 may be replaced with a section of cloth or other flexible material such as neoprene to permanently secure the section ends together and still permit the sections to be partially separated or rotated apart for loading and/or unloading.

Figure 5:
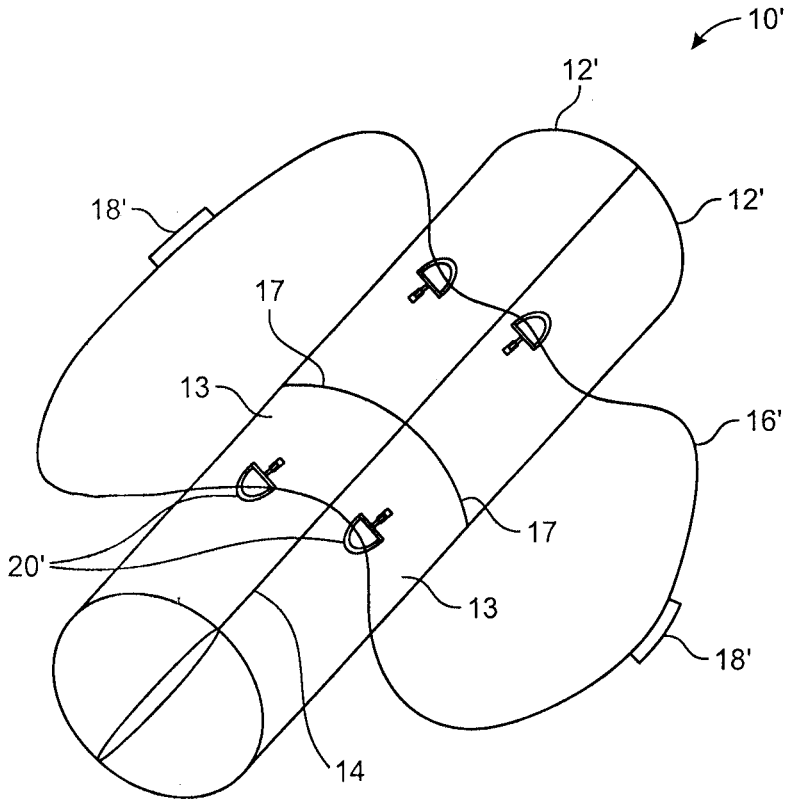
FIG. 5 is a top perspective view in elevation of a single strap, cylindrical duffle bag with quarter sections according to another embodiment of the disclosure.
Figure 6:
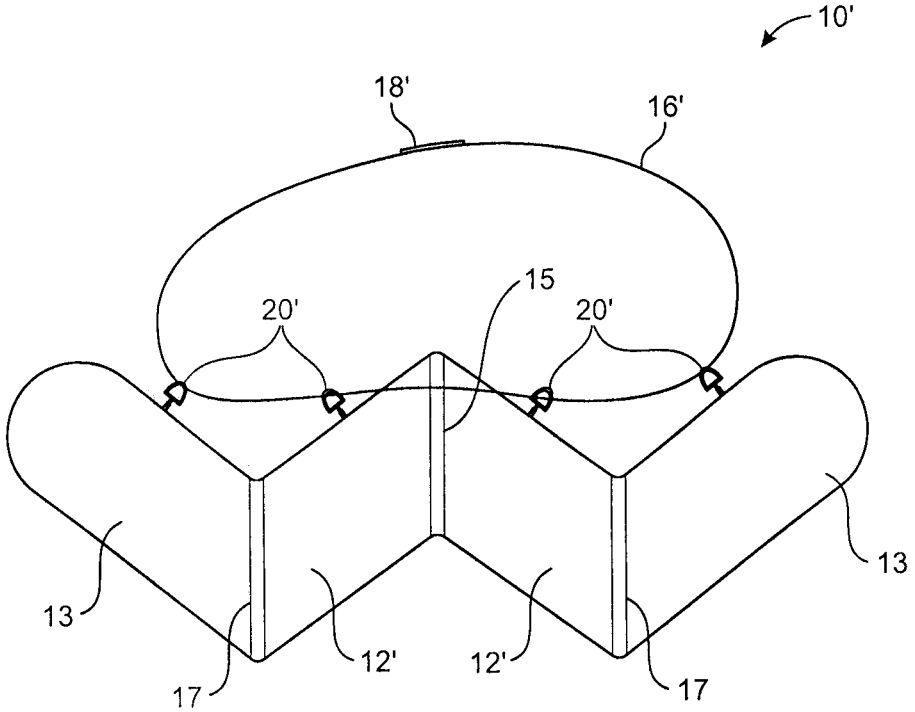
FIG. 6 is an exploded, top perspective view of the duffle bag shown in FIG. 5.

Referring now to FIGS. 5 and 6, in another aspect of the disclosure, a duffle bag designated generally as 10' includes a pair of sections 12' that may be formed as semi-cylindrical sections. As used herein, elements referenced by differently primed or unprimed reference characters correspond to different embodiments of the same element. Sections 12' are secured together along their longitudinal axes with one or two zippers 14'. With two zippers 14', sections 12' can be separated completely into two equal or unequal sections depending upon how each section is structured. For example, one section 12' can be longer than the other section 12' or may have a different radius, if round, to increase or decrease the overall storage space of the section. It should be understood that sections 12' and/or the combination of sections 12' may take on any regular or irregular shape and remain within the scope of the disclosure and appended claims.

One or both sections 12' include at least one secondary zipper 17 (both sections are shown to have a secondary zipper in FIG. 5) that permits each section 12' to be segmented into sub-compartments that may be quarter sections as shown in FIG. 6. Secondary zippers 17 have start and stop ends in close proximity so the zippers extend almost the entire circumference or distance around the sections 12' but leave a permanent connection between the sub-compartments of which a distal compartment 13 can flex away from a base section of sections 12'. Alternatively, secondary zippers 17 may extend around the entire circumference of sections 12' to permit complete separation of the sub compartments. It should be understood that hook-and-loop fasteners and/or magnets may be substituted for any zipper connections disclosed herein.

Duffle bag 10' includes a set of D-ring assemblies 20' with at least two secured to each section 12' and spaced apart to provide balance and stability when bag 10' is lifted and/or carried. Each D-ring assembly 20' may be fixed directly to section 12' or may have a D-ring 21' secured to a post 23', which, in turn, is secured to an anchor plate 25' with the plate secured to section 12'. D-ring 21' can rotate about post 23' and be spring actuated to pull away from the post without disengagement. A single continuous strap 16' is passed through the plurality of D-ring assemblies 20'. The strap length is set to permit the sections 12' duffle bag 20' to be fully unzipped into the connected segmented compartments without interfering with the full separation and axis to the one or more compartments in sections 12' as shown in FIG. 6. One or more shoulder pads/hand grips 18' formed with slots for receiving and interweaving with strap 16' and permit shoulder pad/hand grip 18' to be positioned at different points along strap 16' to provide customization for differently sized individuals.

Figure 7:
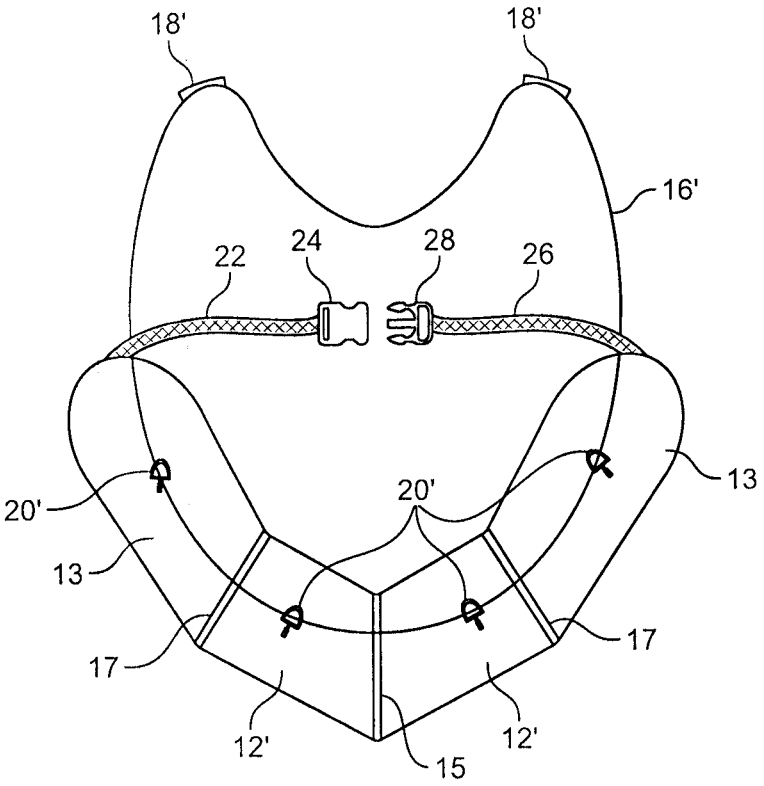
FIG. 7 is a top view of a single-strap, cylindrically-shaped duffle bag with quarter sections and a waist strap according to yet another embodiment of the disclosure.
Figure 8:
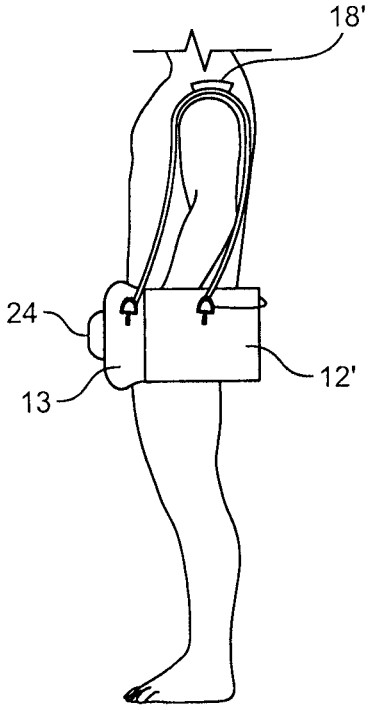
FIG. 8 is a side view of the duffle bag shown in FIG. 7 secured to an individual.

In a further aspect of the disclosure, as shown in FIGS. 7 and 8, the segmented sections of duffle bag 10' can be folded and registered against their outside surfaces to form a u-shaped arrangement. Such an arrangement can be placed around a person's waist. Strap 16' with the two shoulder pad/grips 18' can be arranged to fit over the person's shoulders and function as a harness to suspend duffle bag 10' from the shoulders. An optional belt and buckle assembly as shown in FIG. 7 can be added to the distal segments 13 to provide a means to secure duffle bag 10' around a person's waist.

A first strap 22 is secured to one of the distal segments 13 with a buckle 24 secured to a distal end of first strap 22. Buckle 24 includes an aperture dimensioned (not shown) for receiving a latch tongue 28. A second strap 26 is secured to a second of the distal segments 13 with the latch tongue 28 secured to a distal end of second strap 26. To engage latch tongue 28 to buckle 24, the user simply inserts latch tongue 28 into buckle 24 until releasably locking surfaces of tongue 28 and buckle 24 register and engage one another as is conventional in the art and common knowledge. To disengage the buckle/tongue assembly, the release features of the assembly, e.g., depressible locking tines (shown) or release buttons (not shown) are depressed by the user to disengage the registered surfaces of the buckle 24 and the tongue 28. With the belt and shoulder strap combination, a user can carry duffle bag 10' with minimal effort.

Figure 9:
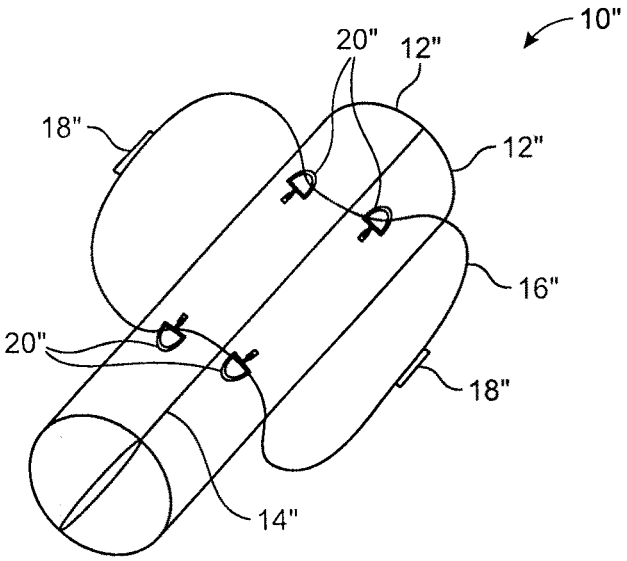
FIG. 9 is a top perspective view of a single-strap, cylindrically-shaped duffle bag according to a further embodiment of the disclosure.
Figure 10:
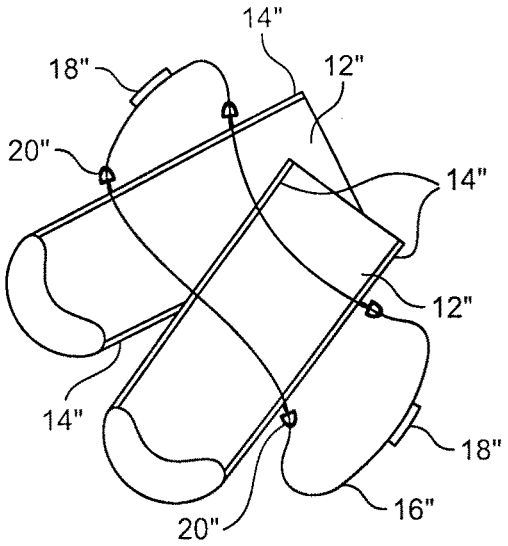
FIG. 10 is a top perspective view of the duffle bag shown in FIG. 9 disassembled.

In a still further aspect of the disclosure as shown in FIGS. 9 and 10, a bag shown designated generally as 10" includes two semi-cylindrical sections 12" secured together with zippers 14" placed along the longitudinal edges of sections 12". Alternatively, sections 12" may be releasably secured together with Velcro® or Velcro-like hook and loop releasable connections and/or magnets as disclosed herein. Each section 12" can have single compartment or may include multiple compartments separated illustratively by dividers, pockets, solid flexible walls and mesh walls. Individual closure means such as additional zippers, snap buttons, magnets and Velcro® hook and loop releasable connections may be used to further separate multiple compartments. The materials used to construct the bag may be mylar, nylon, and like materials.

Secured to each section 12" are at least two D-ring assemblies 20". Each D-ring assembly 20" may be fixed directly to section 12" or may include a D-ring 21" secured to a post 23", which, in turn, is secured to an anchor plate 25" with the plate secured to section 12". D-ring 21" can rotate about post 23" and be spring actuated to pull away from the post without disengagement. A single continuous strap 16" is passed through the plurality of D-ring assemblies 20". The strap length is set to permit the sections 12" of duffle bag 10" to be fully disassembled without interfering with the full separation and axis to the one or more compartments in sections 12" as shown in FIG. 10. One or more shoulder pads/hand grips 18" formed with slots for receiving and interweaving with strap 16" and permit shoulder pad/hand grip 18" to be positioned at different points along strap 16" to provide customization for differently sized individuals.

As shown in FIG. 10, unlike bag 10, a back end of bag 10" does not include a section connection zipper 15 to releasably secure sections 12" together at a single end. The absence of a zipper 15 permits the sections 12" to be fully disconnected but maintained in close proximity with the strap 16".

The materials used to construct the duffle bags and components such as the straps may be the same for all these components. The components may be injection molded with any thermal plastic materials, including, but not limited to, Polypropylene (PP), Polyethylene (PE), Nylon, and mixtures thereof. The components may be stitched or adhered to together with adhesives as is well known in the art. The buckle/tongue assembly and the D-rings may be made from metals or plastics. It should be understood other materials and manufacturing methods well known in the art also may be used to construct the duffle bags and appended components.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A bag comprising:

a pair of fully separable compartment segments, a first compartment segment and a second compartment segment, that combine to form the bag, wherein each compartment segment has two separate and opposing continuous, uninterrupted longitudinal edges the lengths of which extend between a first bag end and a second bag end that define a planar surface of the segment, wherein each longitudinal edge of the first compartment segment aligns with one of the two separate longitudinal edges of the second compartment segment to form a pair of separable aligned longitudinal edges, wherein two pairs of aligned and opposing longitudinal edges are formed, wherein the bag ends of each compartment segment are separate from the bag ends of the other compartment segment, and wherein each compartment segment has at least one bag end free of any connection means;

a pair of separate, non-overlapping longitudinal and separable connection means each secured to substantially the entire length of one of the two separate and opposing longitudinal edges of the first compartment segment and to one of the two separate and opposing longitudinal edges of the second compartment segment that forms the pair of aligned longitudinal edges with the longitudinal edge of the first compartment segment, wherein the longitudinal connection means are selected from the group consisting of zippers, hook and loop fastening systems, magnets, flexible cloth, flexible plastic, neoprene and combinations thereof, wherein the pair of longitudinal connection means permit the pair of compartment segments to be releasably secured together and fully separable;

at least two holding rings secured to each of the pair of fully separable compartment segments; and, a single continuous strap secured through each of the at least two holding rings secured to each of the pair of fully separable compartment segments, wherein the strap can translate freely through the at least two holding rings, wherein the strap permits the pair of compartment segments to be partially or fully separated for access to compartments formed in the segments while maintaining a connection between the pair of fully separable compartment segments.

2. The bag of claim 1 wherein at least one of the pair of separable compartment segments is a multi-compartmented segment.

3. The bag of claim 1 further comprising at least one shoulder pad/hand grip secured to the at least one strap.

4. The bag of claim 3 wherein the at least one shoulder pad/hand grip has slots for receiving the strap, wherein the shoulder pad/hand grip can freely slide along the length of the strap.

5. The bag of claim 1 wherein the at least two D-rings are a plurality of strap-holding rings or D-rings.

6. The bag of claim 5 wherein at least one of the plurality of D-rings are secured to a post secured to one of the pair of compartment segments, wherein the at least one D-ring freely rotates about the post.

7. The bag of claim 1 further comprising a compartment segment end connection means for securing one end of each compartment segment together, wherein the end connection means is selected from the group consisting of zippers, hook and loop fastener systems, magnets, flexible cloth, flexible plastic, neoprene and combinations thereof.

8. The bag of claim 1 wherein the single continuous strap is a pair of separate continuous straps, wherein each strap of the pair of separate continuous straps is secured to one of the at least two D-rings of each of the separable compartment segments, wherein each of the pair of separate continuous straps permit the pair of compartment segments to be completed disassembled and separated while maintaining a connection between the pair of fully separable compartment segments.

* * * * *